United States Patent [19]

Sargent

[11] 3,998,135

[45] Dec. 21, 1976

[54] BAG STRUCTURE AND METHOD OF PRODUCING

[75] Inventor: Cassius E. Sargent, Chicago, Ill.

[73] Assignee: PPC Industries, Inc., Wheeling, Ill.

[22] Filed: Apr. 10, 1975

[21] Appl. No.: 566,925

Related U.S. Application Data

[60] Continuation of Ser. No. 482,745, June 24, 1974, abandoned, which is a division of Ser. No. 319,861, Dec. 29, 1972, abandoned, which is a continuation-in-part of Ser. No. 143,889, May 17, 1971, Pat. No. 3,762,628, which is a continuation-in-part of Ser. No. 143,895, May 17, 1971, Pat. No. 3,708,106.

[52] U.S. Cl. ..... 93/35 R; 53/14; 156/201; 156/290

[51] Int. Cl.[2] ..... B31B 1/60

[58] Field of Search ..... 93/35 R, 8 WA, 19, 20; 156/201, 289, 290, 291, 554; 229/87 B; 53/14; 206/525

[56] References Cited

UNITED STATES PATENTS

| | | | |
|---|---|---|---|
| 1,849,774 | 3/1932 | Taylor | 206/525 X |
| 2,260,064 | 10/1941 | Stokes | 53/14 |
| 2,647,334 | 8/1953 | Wilsher et al. | 229/87 B X |
| 3,182,893 | 5/1965 | Bremkamp | 229/87 B |
| 3,338,019 | 8/1967 | Trewella et al. | 93/20 X |

*Primary Examiner*—James F. Coan
*Attorney, Agent, or Firm*—Tilton, Fallon, Lungmus, Chestnut & Hill

[57] ABSTRACT

A bag structure of the flap type wherein the flap is tack heat-sealed for ready opening by virtue of heat-sealing webs together, wherein the heat-seal overlies a coating substantially resistant to union with thermoplastic material when the latter is in a molten state.

2 Claims, 8 Drawing Figures

BAG STRUCTURE AND METHOD OF PRODUCING

This application is a continuation of my copending application Ser. No. 482,745, filed June 24, 1974, and now abandoned, which in turn was a divisional case of my application Ser. No. 319,861, filed Dec. 29, 1972, and now abandoned which in turn was a continuation-in-part of each of my applications Ser. Nos. 143,889 and 143,895, both filed May 17, 1971 (now U.S. Pat. Nos. 3,762,628 and 3,708,106, respectively).

BACKGROUND AND SUMMARY OF INVENTION

Although varieties of bags constructed of flexible thermoplastic material have been available in the past, there has existed a problem of providing these bags with a secure closure, yet one which is readily openable without harsh wrenching. Through the use of a resistive coating, it is now possible to provide such a closure. The coating is printed on a web, and thereafter a second web is advanced in partial lapping relation to the first web. The coating is equipped with interrupted portions so that when a longitudinal seal is made between the two webs, the webs are tacked together at spaced-apart areas yielding ready but selective release. Also, according to this invention, I utilize this type of closure (originally disclosed in Ser. No. 143,895) in combination with the coupon arrangement disclosed in Ser. No. 143,889.

DETAILED DESCRIPTION OF THE INVENTION

The invention is described in conjunction with an illustrative embodiment in the accompanying drawing in which.

Figure 1:
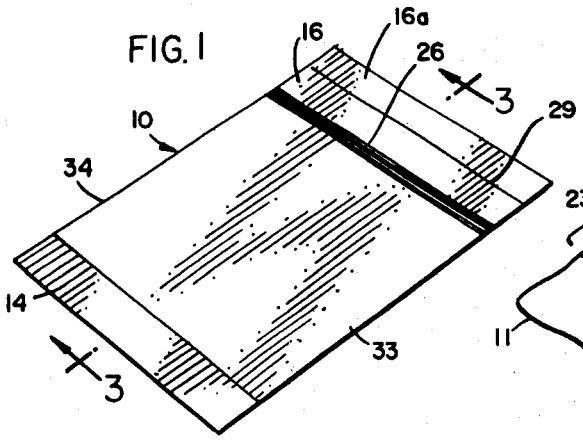
FIG. 1 is a perspective view of a bag structure constructed according to the teachings of this invention.
Figure 3:
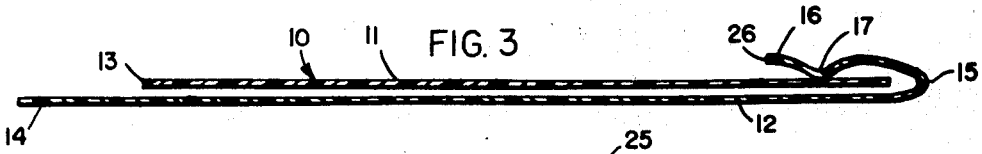
FIG. 3 is a longitudinal sectional view of the structure of FIG. 1 as would be seen along the sight line 3—3 applied to FIG. 1.

In the illustration given, and with reference to FIG. 1, the numeral 10 designates generally the bag structure of the instant invention. The bag structure is seen to be essentially rectangular and, as can be appreciated from FIG. 3, is made up of a first sheet or panel 11 and a second sheet or panel 12, both of flexible thermoplastic material which may be advantageously opaque. The bag structure 10 is open at one end, as at 13, for filling with merchandise. In the illustration given, the second sheet 12 extends beyond the first sheet 11 to provide a portion 14 which, after the bag is filled, may be folded over the sheet 11 and heat-sealed to complete the bag.

The end 15 of the bag structure 10 is seen to be closed by a flap 16 which is heat-sealed as at 17 to the first sheet 11.

Figure 4:
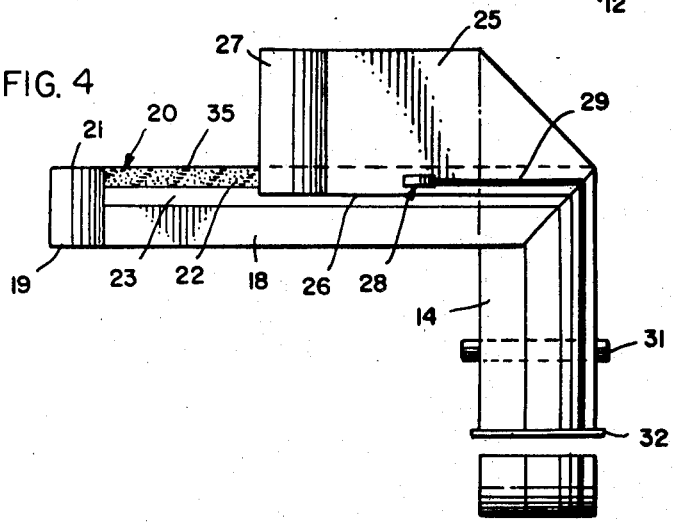
FIG. 4 is a plan view of a schematic representation of a method and apparatus for producing the bag structure of FIG. 1.
Figure 5:
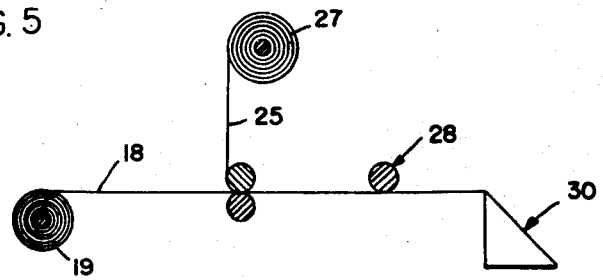
FIG. 5 is a side elevational view of the schematic representation of FIG. 4.

It is believed that the invention can be most readily appreciated from a consideration of the method of producing the bag structure 10, and for this purpose reference is made to FIGS. 4 and 5. In the practice of the invention, a first elongated thermoplastic flexible web 18 is advanced from a parent roll 19. The web 18 has imprinted thereon a coating generally designated 20 adjacent one longitudinal edge 21. The coating can either be performed "in-line" or prior to the reeling of the web to provide the parent roll 19. The coating 20 is essentially an elongated band divided into two sub-bands or portions 22 and 23. The portion 22 (also designated in FIG. 2) is immediately adjacent the longitudinal edge 21, and is interrupted in various areas, as at 24, to expose the web 18. On the other hand, the band 23 is substantially continuous, i.e., without interrupted portions.

The web 18 is advanced along a predetermined path (to the right initially in FIG. 4), and during the course of travel enters into lapping relation with a second web 25. Like the web 18, the web 25 is constructed of flexible thermoplastic material, and is likewise advanced along the same general path. From FIG. 4 it will be seen that one longitudinal edge 26 of the web 25 is positioned so as to be aligned with the uninterrupted band portion 23. As the webs 18 and 25 proceed along the path in partial lapping relation, the web 25 being provided from a parent roll 27, they encounter a heat-sealing mechanism generally designated 28 which develops a longitudinal seal 29. Thereafter, the webs encounter a V-forming device generally designated 30 (see FIG. 5) which folds the web 25 on itself, and, in the illustration given, under the web 18. This provides the extension portion 14. Advancement of the webs along the path is conveniently achieved by draw rolls (alternatively a pull belt arrangement) schematically represented in FIG. 4 and designated by the numeral 31. Thereafter, the webs are transversely heat-sealed and severed by means of transverse heat-sealing knives as indicated at 32, providing side seals for the bag 10 as at 33 and 34 in FIG. 1.

Figure 2:
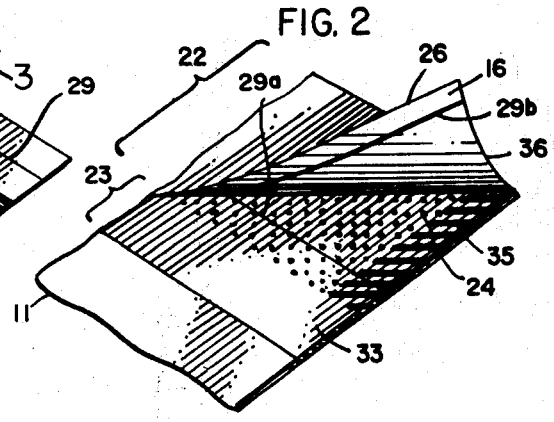
FIG. 2 is an enlarged perspective fragmentary view of a top corner of the bag structure of FIG. 1.

In FIG. 2, the upper right hand corner of a bag is seen in the process of being opened. The flap portion 16 is seen to be in the process of being stripped away from the first sheet 11, with a remnant of the heat-seal being designated **29*a* relative to the sheet 11, and 29*b* relative to the flap 16 (being a portion of the sheet 12). The heat-seal 29 is provided in an area where the resist coating 20 has been interrupted as by the dots 24, so that, in effect, the heat-seal is a series of relatively small "tacks". Further, the flap 16 is of such a width relative to the location of the longitudinal heat-seal 29 so as to overlie the uninterrupted band portion 23. Thus, there is no possibility that the free edge 26 will become sealed. This provides a conveniently manually manipulatable flap edge portion or selvage for the user to grasp in opening the bag 10**.

It is also advantageous, in some instances, to provide an area of greater interruption, as at 35 (see FIGS. 2 and 4), in the area where the transverse seals 33 and 34 are achieved. This insures that there will be a slightly stronger seal achieved along the side edges 36 of the flap 16, but not so strong a union as is achieved between the sheets 11 and 12.

A wide variety of patterns and coatings may be employed for the purpose of practicing the invention. For a bag 13½ inches by 10½ inches, with a 2½ inch flap 16, it is advantageous to coat the upper three inches to provide the band 20, and where the thermoplastic material is opaque polyethylene, a suitable resistive coating is made up of white pigment and laminating varnish such as is obtainable from Converters, Inc., of Chicago, Illinois, under product designation V-41852. The heat-seal 29 is located 1¼ inches from the top of the bag, and the interruptions 24 are dots about 1/32 inch in diameter spaced on 1/16 to ⅛ inch centers. The greater interrupted areas 34 can be diagonal stripes about 1/16 inch in width and extending over about ½ inch of web length so as to provide ¼ inch on each side of the transverse seal 33. By enlarging the interruptions or exposed areas, a stronger seal can be made — the strength of the seal depending on the material being packaged, the packaging material, and the contemplated handling. In some instances I may provide a second longitudinal seal parallel to the seal 29 but between it and the edge 26. This is a weak seal, overlying the area 23, but serves to protect the main seal 26 from being unduly stressed in shipment or the like.

In still other instances of contemplated use, the provision of interrupted "resist" portions is advantageous in providing a relatively secure but relatively easily opened closure. In some instances I may perforate the flap 16 in the portion 16*a* (see FIG. 1) and secure over the perforations a cellulosic sheet which is permeable to gas, yet is impermeable to organisms and other pyrogenic material. In this way, the interior of the bag structure 10 can be gas sterilized as by the use of ethylene oxide, yet the advantage of the easy opening feature is retained.

Figure 6:
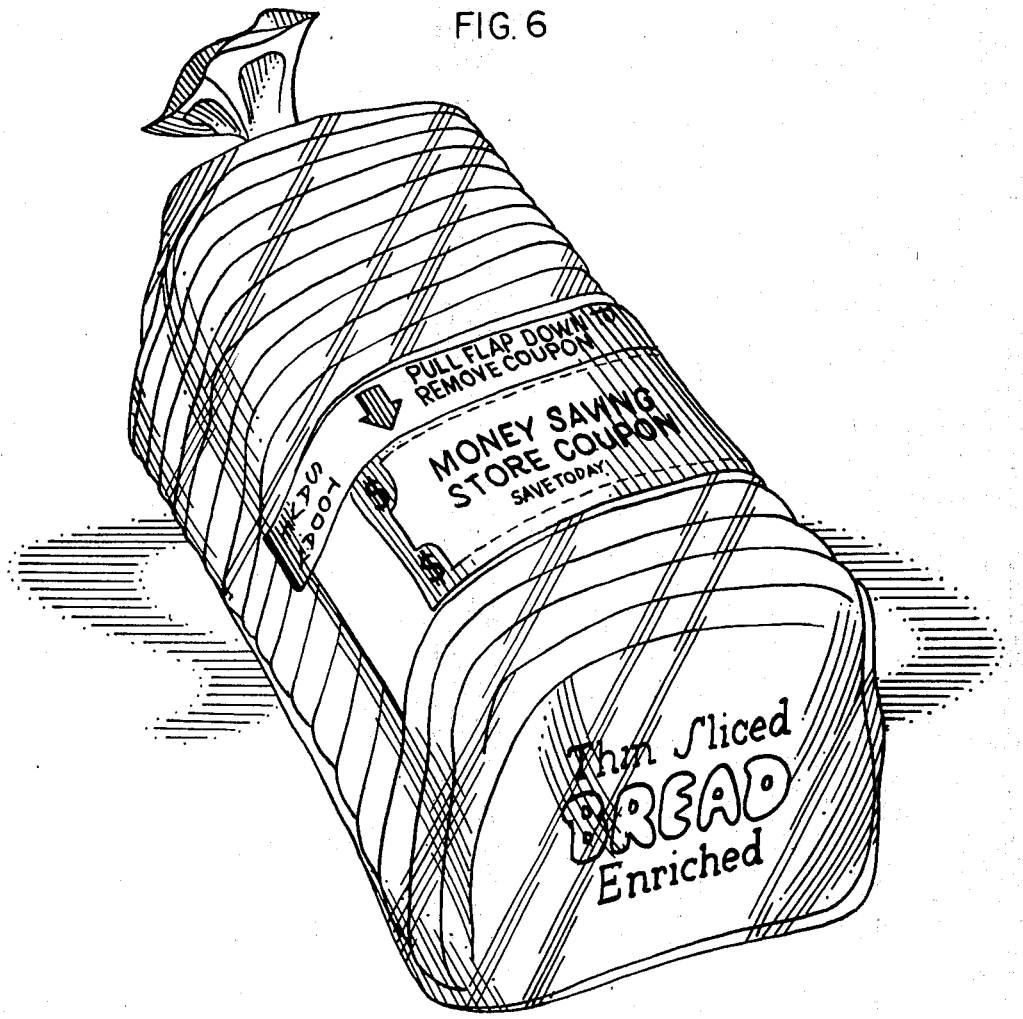
FIG. 6 is a perspective view of a loaf of bread in a wrapper embodying teachings of the instant invention.
Figure 7:
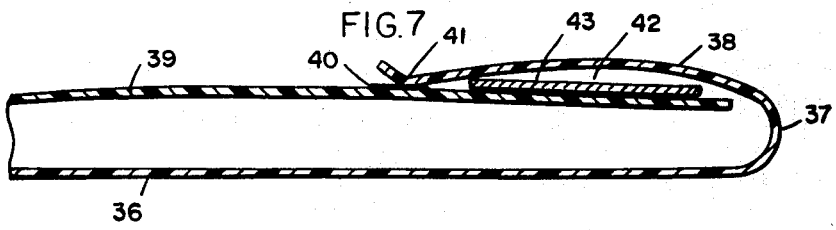
FIGS. 7 and 8 are views similar to FIG. 3, but of modified forms of the invention.

In FIG. 6, a bag constructed according to the teachings of this invention is employed for wrapping a loaf of bread. The structure of the bag in FIG. 6 is illustrated schematically in FIG. 7. In FIG. 7 the numeral 36 designates a sheet of flexible thermoplastic material which is folded on itself as at 37 to provide an overlapped portion 38. A second sheet of thermoplastic material is designated 39. The sheet 39 is equipped with a coating 40 which is similar to the coating previously designated 20 and which serves to resist union of the thermoplastic material when the latter is in molten condition. Also, as described previously hereinbefore, the coating 40 is interrupted at spaced areas to permit a union between the flap portion 38 and the web or sheet 39, as at 41. The overlap of the flap portion 38 relative to the sheet 39 provides a chamber 42 in which a coupon 43 is received.

Figure 8:
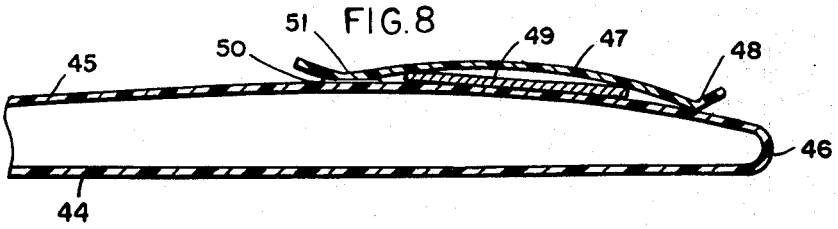

A modification of the structure just described can be seen in FIG. 8 where the web of thermoplastic material has overlapped portions 44 and 45 developed by a reverse fold as at 46. Secured to the panel 45 is a covering of thermoplastic material 47 which is heat-sealed to the panel 45 at 48. A coupon 49 is inserted between the sheets 45 and 47 with a readily openable closure being provided through the combination of an interrupted resist coating 50 and a transverse heat-seal 51.

It will be appreciated that the coatings 20, 40, or 50, as the case may be, can be applied to either of the sheets cooperating to form the readily openable seal. Further, as is described in greater detail in my earlier application, Ser. No. 143,889, the coupons 43 or 49 may be advantageously inserted during the formation of the bag structure, i.e., during the coating and sealing procedures.

I claim:

1. A method of producing a coupon-confining bag comprising advancing two continuous flexible transparent thermoplastic webs toward a folding member with one web being wider than the other, inserting coupons sequentially between said webs, orienting said webs in superposed relation, longitudinally uniting said webs along a first longitudinal line adjacent an edge of the other web, longitudinally folding said one web along a second longitudinal line spaced from said first longitudinal line to form a bag from said one web, and transversely sealing said webs between sequential coupons.

2. The method of claim 1 in which said coupons are severed from a continuous web in synchronism with the rate of advance of said sheet.

* * * * *